United States Patent [19]

Matsubara

[11] Patent Number: 4,484,557

[45] Date of Patent: Nov. 27, 1984

[54] VARIABLE VENTURI CARBURETOR

[75] Inventor: Mamoru Matsubara, Obu, Japan

[73] Assignee: Asian Kogyo Kabushiki Kaisha, Aichi, Japan

[21] Appl. No.: 381,900

[22] Filed: May 25, 1982

[30] Foreign Application Priority Data

Jul. 13, 1981 [JP] Japan ..... 56-109599

[51] Int. Cl.[3] ..... F02M 7/00

[52] U.S. Cl. ..... 123/439; 123/437; 261/44 C; 261/121 B

[58] Field of Search ..... 123/439, 440; 261/44 C, 261/121 B, DIG. 56

[56] References Cited

U.S. PATENT DOCUMENTS

| | | | |
|---|---|---|---|
| 3,899,552 | 8/1975 | Bauer | 261/44 C |
| 3,963,009 | 6/1976 | Mennesson | 261/44 C |
| 4,290,399 | 9/1981 | Takada et al. | 123/439 |
| 4,360,482 | 11/1982 | Asai | 261/44 C |
| 4,369,749 | 1/1983 | Sugi | 123/439 |

FOREIGN PATENT DOCUMENTS

| | | | |
|---|---|---|---|
| 57-81148 | 5/1982 | Japan | 123/439 |
| 57-188750 | 11/1982 | Japan | 123/439 |
| 2099924 | 12/1982 | United Kingdom | 261/DIG. 56 |

*Primary Examiner*—Ethel R. Cross

*Attorney, Agent, or Firm*—Leonard Bloom

[57] ABSTRACT

Disclosed herein is a variable venturi carburetor adapted for controlling the air-fuel ratio by air bleeding operation which includes an actuator for controlling the amount of bleed air in response to the engine running conditions and a fuel jet having a fuel metering portion and an air bleed portion provided downstream of and adjacent to the fuel metering portion. The air bleed portion has an outlet opening adapted for delivering bleed air into the fuel passage and the inside diameter of the air bleed portion is designed to be slightly larger than that of the fuel metering portion. Especially, at engine idle operation, the restriction area of the air bleed portion is designed to become larger than that adjusted by the actuator and the inside diameter of the fuel passage downstream of the air bleed portion is designed to become large in such a manner that air and fuel flows may not be influenced by the restricting operation of the air bleed portion.

2 Claims, 9 Drawing Figures

VARIABLE VENTURI CARBURETOR

BACKGROUND OF THE INVENTION

This invention relates to a variable venturi carburetor for an internal combustion engine which controls the air-fuel ratio by air bleed control operation.

In a conventional carburetor, the air-fuel ratio is controlled by varying the amount of bleed air admitted into an air chamber in the fuel jet of the carburetor. Such an air chamber is the annular space defined between the first orifice formed by the fuel metering portion of the fuel jet and by the fuel metering needle and the second orifice formed by the fuel-air mixture discharge portion of the fuel jet and by the fuel metering needle. The amount of bleed air is controlled by the actuator which is operated in response to the output signal transmitted from a computer into which the signals transmitted from sensors for sensing the engine running conditions are inputted. In such a control system, the fuel injected from the fuel metering portion and the bleed air delivered through an air bleed passage are mixed in the said annular space and the fuel-air mixture is discharged into the venturi portion. The flow rate of the fuel or the bleed air and the relative flow rate thereof are varied with the engine running conditions. In general, there arises a case where the flow rate is unstable with respect to a certain value of gas or liquid flow rate and relative flow rate thereof. Under these conditions, when the fuel-air mixture is metered by the said second orifice, the mixture is disadvantageously variably discharged. To avoid this drawback, the inside diameter of the discharge portion may be enlarged so as for the fuel-air mixture not to variably discharged. However, in this case, there arises a problem that "bleed sensitivity", that is, the variation in the air-fuel ratio relative to the variation in the restriction created by the actuator, is reduced. This is caused by the fact that the pressure variation within the annular space relative to the constant variation in the restriction created by the actuator is decreased with an increase in the annular opening area of the second orifice formed at the discharge portion.

In another conventional variable venturi carburetor including a fuel jet provided with a jet portion, the jet portion is provided with an air bleed aperture through which bleed air is delivered into the annular restriction opening defined between the fuel metering needle and the jet portion. In this case, the amount of bleed air may be controlled by the sensors, computer and actuator as mentioned in connection with the preceding variable venturi carburetor, thereby permitting the air-fuel ratio to be controlled. As the amount of induced air flowing through the venturi portion of the air intake passageway is decreased, the said annular restriction opening area at the jet portion is decreased, and therewith the "bleed sensitivity" is increased. When the amount of induced air is further decreased until the engine reaches the idle condition, the air bleed aperture into the jet portion is nearly closed by the fuel metering needle (see FIG. 6). Accordingly, it should be apparent that the air-fuel ratio cannot be controlled by the air bleeding operation as depicted by the solid line in FIG. 7.

SUMMARY OF THE INVENTION

Accordingly, it is a primary object of the present invention to provide a variable venturi carburetor which obviates the above mentioned drawbacks and is designed to control the air-fuel ratio by air bleeding operation.

It is another object of the present invention to provide a variable venturi carburetor which assures a constant "bleed sensitivity" sufficient to control the air-fuel ratio at a constant level irrespective of the amount of induced air flowing through the air intake passageway.

It is a further object of the present invention to provide a variable venturi carburetor which improves a control efficiency of the air-fuel ratio and stabilizes a drivability of engine, thereby increasing fuel economy.

According to this invention, the variable venturi carburetor is adapted to control the air-fuel ratio by air bleeding operation which includes an actuator for controlling the amount of bleed air in response to the engine running conditions and a fuel jet having a jet portion and an air bleed portion provided downstream of and adjacent to the jet portion. The air bleed portion has an outlet opening adapted for delivering bleed air into the fuel passage and the inside diameter of the air bleed portion is designed to be slightly larger than that of the jet portion. Especially, at engine idle operation, the restriction area of the air bleed portion is designed to become larger than that adjusted by the actuator and the inside diameter of the fuel passage downstream of the air bleed portion is designed to become large in such a manner that air and fuel flows may not be influenced by the restricting operation of the air bleed portion.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
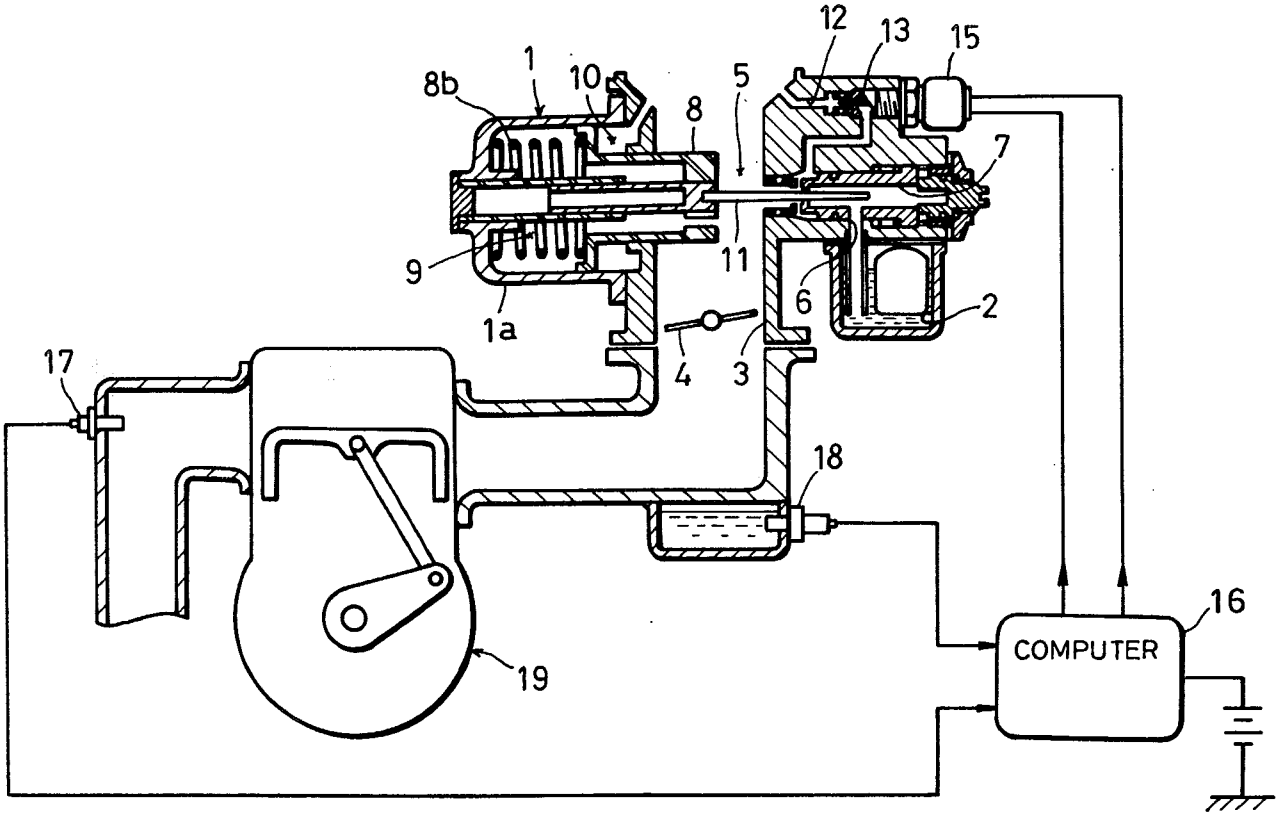
FIG. 1 is a schematic vertical sectional view of a variable venturi carburetor, employing teachings of the present invention, along with an associated engine.
Figure 2:
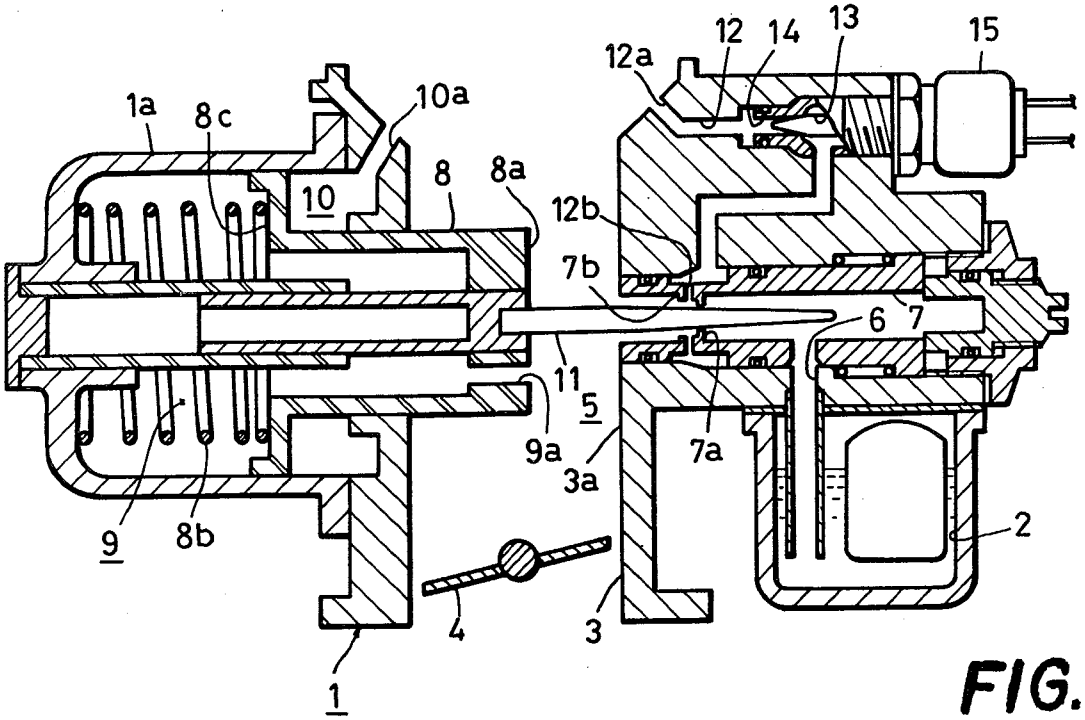
FIG. 2 is an enlarged vertical sectional view of the variable venturi carburetor shown in FIG. 1.

Referring now to FIGS. 1 and 2, reference numeral 1 designates a carburetor body 1 of a variable venturi type having a float chamber 2, an air intake passage 3, a throttle valve 4 and a venturi portion 5. Reference numeral 6 designates a fuel passage communicating with the float chamber 2 and the venturi portion 5. The fuel passage 6 is provided with a fuel jet 7. The venturi portion 5 is defined upstream of the throttle valve 4 by the inside wall 3*a* of the air intake passage 3 and the bottom end 8*a* of a suction piston 8. A suction chamber 9 is defined by a cylindrical portion 1*a* of the carburetor body 1 and the suction piston 8 slidably inserted into the cylindrical portion 1*a*. A compression spring 8*b* is inserted in the suction chamber 9 and serves to normally urge the suction piston 8 toward the inside wall 3*a* of the air intake passage 3. A vacuum communication port 9*a* is provided at the bottom end 8*a* of the suction piston 8 and adapted to communicate with the suction chamber 9 and the venturi portion 5. An atmospheric pressure chamber 10 is defined by the sliding flange portion 8*c* of the suction piston 8 and the carburetor body 1 and provided with an atmospheric pressure communication port 10*a* in the vicinity of the inlet of the air intake passage 3, whereby ambient air is induced through the port 10*a*. A fuel metering needle 11 is fixed to the bottom end 8*a* of the suction piston 8 at its center portion. The free end of the metering needle 11 is laterally reciprocatingly inserted in the interior of the fuel jet 7.

Figure 3B:
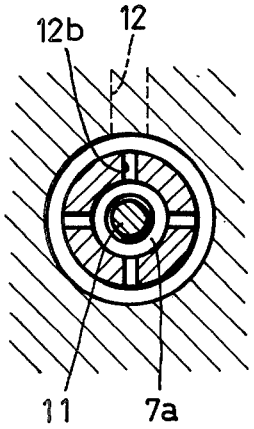
FIG. 3B is a cross-sectional view taken along the line III—III of FIG. 3A.
Figure 3A:
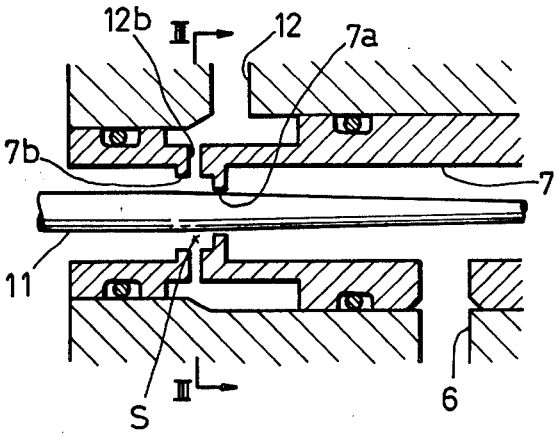
FIG. 3A is a vertical sectional view of the essential part of the variable venturi carburetor according to the first preferred embodiment.

Reference numeral 12 designates an air bleed passage having an inlet 12*a* provided in the vicinity of the inlet of the air intake passage 3 and an outlet 12*b* provided downstream of the jet portion or fuel metering portion 7*a* of the fuel jet 7. The fuel jet 7 is provided with an air bleed portion 7*b* downstream of the jet portion 7*a*. The air bleed portion 7*b* including the outlet 12*b* of the air bleed passage 12 serves as an air flow restricting means. The inside diameter of the air bleed portion 7*b* is designed to be slightly larger than that of the jet portion 7*a* as seen in FIGS. 3A and 3B.

As shown in FIGS. 1 and 2, on the way of the air bleed passage 12 to the fuel passage 6, there are mounted a needle 13 for varying the annular area of the air bleed passage 12, its associated seat 14 and an actuator 15 therefor. The actuator 15 is controlled by output signals from a computer 16 to which are transmitted input signals from an oxygen sensor 17 and an engine coolant temperature sensor 18 adapted for sensing the conditions of engine 19, so as to drive the needle 13.

The annular area defined by the bleed air restricting portion 7*b* and the metering needle 11 is preset to minimum at idle engine operation and also preset to be larger than the annular area defined by the needle 13 and the seat 14 which area is controlled by the actuator 15 to the value required for the air-fuel ratio control.

Figure 4B:
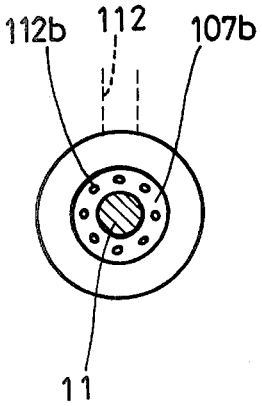
FIG. 4B is a cross-sectional view taken along the line IV—IV of FIG. 4A.
Figure 4A:
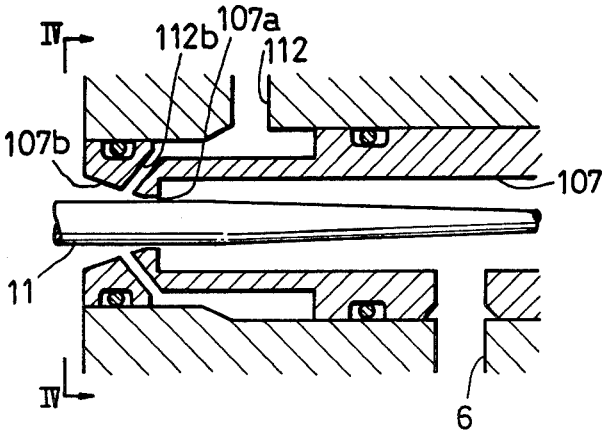
FIG. 4A is a vertical sectional view similar to FIG. 3A according to the second preferred embodiment.

FIGS. 4A and 4B show another preferred embodiment of the present invention in which reference numerals 107, 107*a*, 112 and 112*b* designate a fuel jet, jet portion, air bleed passage and outlet of the air bleed passage, respectively. The inside diameter of the jet portion 107*a* is equal to that of the upstream end of the air bleed portion 107*b*, which is substantially conical in such a manner that the inside diameter of the air bleed portion 107*b* progressively increases from its upstream end to its downstream end opening into the venturi portion 5. The tapering angle of the conical air bleed portion 107*b* is designed to be larger than that of the metering needle 11.

As shown in FIG. 3B, four outlets 12*b* of the air bleed passage 12 are arranged on the circumference of the air bleed portion 7*b* in equally spaced relation with each other. Similarly, in FIG. 4B, eight outlets 112*b* of the air bleed passage 112 are arranged on the circumference of the air bleed portion 107*b* in equally spaced relation with each other. In both FIGS. 3B and 4B, total of the opening areas of the outlets 12*b* and 112*b* which open into the fuel passage 6 is preset to be larger than the annular area defined by the needle 13 and the seat 14. However, it will be noted that the arrangement and the number of the outlets 12*b* and 112*b* may be determined as desired.

In operation of the first preferred embodiment illustrated in FIGS. 1 through 3, the liquid fuel stored in the float chamber 2 is sucked up through the fuel passage 6 into the fuel jet 7 by a constant vacuum created in the venturi portion 5. The sucked fuel is metered by the fuel metering jet 7*a* and then injected through the downstream end or the left end of the fuel jet 7 to the venturi portion 5. At this time, ambient air induced through the air bleed passage 12 is delivered through the outlet 12*b* of the air bleed portion 7*b*. As the result, the negative pressure at the fuel metering jet 7*a* varies from the constant vacuum prior to the air bleeding operation due to the positive pressure of the bleed air. Accordingly, the metered fuel at the fuel metering jet 7*a* is controlled by varying the amount of bleed air delivered through the outlet 12*b* of the air bleed portion 7*b*, and thereby the air-fuel ratio can be controlled. Such control operation of bleed air is carried out in response to the engine conditions by the oxygen sensor 17, engine coolant temperature sensor 18, computer 16 and actuator 15, thereby permitting the air-fuel ratio to be maintained at an optimum value responsive to the engine conditions.

Figure 5:
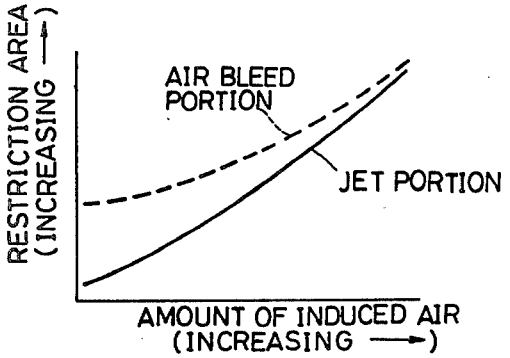
FIG. 5 is a graph illustrating change in the restriction area of the jet portion and the air bleed portion in relation to change in the amount of induced air according to the present invention.
Figure 6:
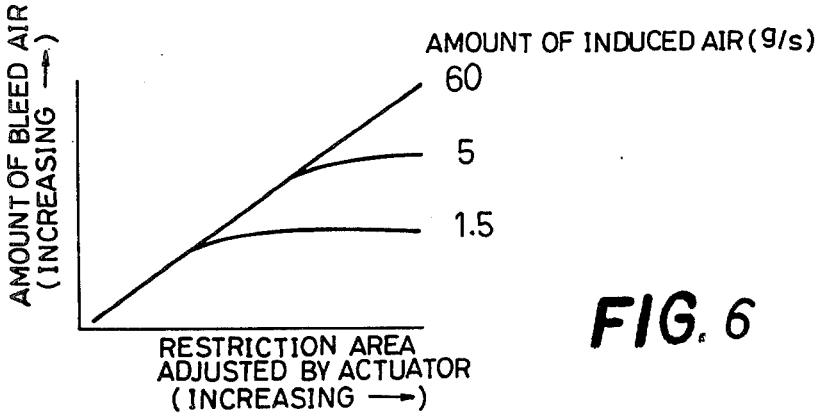
FIG. 6 is a graph illustrating change in the amount of bleed air in a venturi carburetor of a conventional type wherein an air bleed opening is provided at a jet portion, in relation to change in the restriction area adjusted by an actuator.
Figure 7:
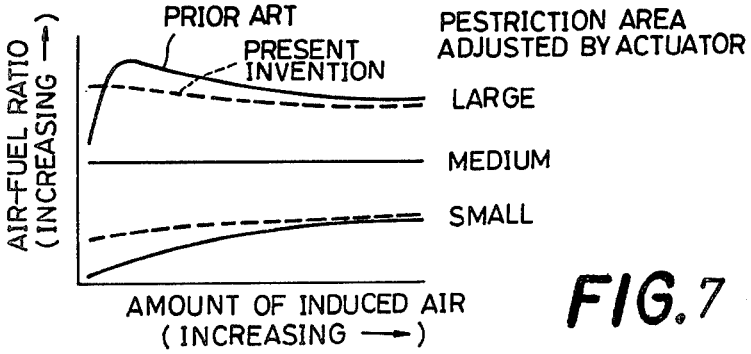
FIG. 7 is a graph illustrating the characteristics of the air-fuel ratio in relation to change in the amount of induced air according to the prior art and the present invention.

To accomplish the air-fuel ratio control by such air bleeding operation, the fuel jet 7 is not provided with a restriction means downstream of the air bleed portion 7*b*. As the result, unstable flow of air-fuel mixture is not created as seen in the prior art, but air and fuel are separately delivered to the venturi portion 5 under the state of laminar flow. In the case that the annular space S defined between the air bleed outlet 12*b* and the fuel metering needle 11 is large, variation of the air-fuel ratio relative to variation of the annular opening area defined between the bleed air metering needle 13 and the seat 14, that is, "bleed sensitivity" is decreased. However, in this embodiment, the annular space S is preferably restricted by the bleed air restricting portion 7*b*, thereby permitting the "bleed sensitivity" to be remained at the optimum level. Since the inside diameter of the bleed air restricting portion 7*b* is designed to be larger than that of the fuel metering portion 7*a*, even when the amount of induced air flowing through the intake passageway 3 is small, necessary annular opening area defined between the bleed air restricting portion 7*b* and the fuel metering needle 11 may be remained, thereby preventing the "bleed sensitivity" from becoming excessive, and also preventing the air bleed outlet 12*b* from shutting off at idle operation as seen in FIGS. 5 and 7.

The operation of the second preferred embodiment is substantially identical with that of the first preferred embodiment except that the inside diameter of the bleed air restricting portion 107*b* is designed to gradually increase from the left end of the fuel metering portion 107*a* to the discharge end opening into the venturi portion 5, thereby resulting in superior atomization of the fuel-air mixture to be discharged into the venturi portion 5 in comparison to the first preferred embodiment.

Having thus described the preferred embodiments of the invention it should be understood that numerous structural modifications and adaptations may be re-stored to without departing from the spirit of the invention.

What is claimed is:

1. In a variable venturi carburetor for an internal combustion engine having a float chamber, an air intake passage including an upstream portion, a venturi portion provided in the air intake passage, a fuel passage communicating with the float chamber and the venturi portion, a fuel jet provided in the fuel passage and including a fuel metering portion having a downstream portion and a portion defining annular opening area, a suction piston having a bottom end and postioned for reciprocating transversely across the venturi portion in response to load conditions of the engine, and a fuel metering needle fixed to the bottom end of the suction piston at its base portion for controlling an annular opening area of the fuel metering portion of the fuel jet by reciprocation of its free end; the improvement comprising an air bleed passage having a changeable cross-sectional area and an inlet opening into said upstream portion of said air intake passage and an outlet opening into said downstream portion of said fuel metering portion of said fuel jet, actuator means provided adjacent to said air bleed passage for controlling the amount of bleed air by changing said cross-sectional area of said air bleed passage in response to engine load conditions, an air bleed portion formed directly downstream of said fuel metering portion and having a circumference and diameter which is larger than that of said fuel metering portion, said inside diameter of said air bleed portion being such that at engine idle operation, the restriction area of said air bleed portion is larger than that adjusted by said actuator so as to effect an optimum control of the air-fuel ratio, said fuel passage having an inside diameter downstream of said air bleed portion larger than that of said air bleed portion, said outlet of said air bleed portion being comprised of at least one opening arranged along said circumference of said air bleed portion.

2. The variable venturi carburetor as defined in claim 1, wherein said metering needle is tapered and said air bleed portion is connected at its upstream end to an inner surface of said fuel metering portion and conically spreads toward its downstream end opening into said venturi portion at an angle larger than the tapering angle of said metering needle.

* * * * *